US005812909A

United States Patent [19]

Oguma et al.

[11] Patent Number: 5,812,909

[45] Date of Patent: Sep. 22, 1998

[54] DEVELOPING DEVICE

[75] Inventors: Toru Oguma; Tadayuki Tsuda, both of Susono; Shinichi Sasaki, Fujisawa; Toshiyuki Karakama, Tokyo, all of Japan

[73] Assignee: Canon Kabushiki Kaisha, Tokyo, Japan

[21] Appl. No.: 902,901

[22] Filed: Jul. 30, 1997

[30] Foreign Application Priority Data

Aug. 1, 1996 [JP] Japan ..... 8-219454

[51] Int. Cl.[6] ..... G03G 15/08

[52] U.S. Cl. ..... 399/103; 399/104

[58] Field of Search ..... 399/91, 98, 102, 399/103, 104

[56] References Cited

U.S. PATENT DOCUMENTS

| | | | |
|---|---|---|---|
| 5,187,326 | 2/1993 | Shirai | 399/104 |
| 5,267,007 | 11/1993 | Watanabe et al. | 399/104 |
| 5,450,169 | 9/1995 | Hart et al. | 399/104 |

FOREIGN PATENT DOCUMENTS

| | | |
|---|---|---|
| 0723211 | 7/1996 | European Pat. Off. . |
| 61-172173 | 8/1986 | Japan . |
| 3-13977 | 1/1991 | Japan . |
| 7-168449 | 4/1995 | Japan . |
| 8-30094 | 2/1996 | Japan . |
| 8-137275 | 5/1996 | Japan . |

*Primary Examiner*—Arthur T. Grimley
*Assistant Examiner*—Hoan Tran
*Attorney, Agent, or Firm*—Fitzpatrick, Cella, Harper & Scinto

[57] ABSTRACT

A developing device includes a container for containing a magnetic developer therein, a developer carrier for carrying and conveying the magnetic developer in the container, a magnetic member for forming a magnetic seal area of a predetermined gap with respect to the surface of the developer carrier in the end portions of the developer carrier along the circumferential direction of the developer carrier. The magnetic member has a plurality of magnetic poles along the circumferential direction of the developer carrier in the magnetic seal area, and an external magnetic pole provided outside the endmost magnetic pole forming the magnetic seal for conveying a magnetic flux travelling from the endmost magnetic pole toward the outside of the magnetic seal area.

10 Claims, 10 Drawing Sheets

20
3
g
g
8
8a
6B 8b
8a
8

DEVELOPING DEVICE

BACKGROUND OF THE INVENTION

1. Field of the Invention

This invention relates to a developing device for use in an image forming apparatus such as a copying apparatus or a printer of the electrophotographic type or the electrostatic recording type, and for developing an electrostatic latent image on an image bearing member.

2. Related Background Art

There have heretofore been utilized numerous image forming apparatuses such as copying apparatuses and printers which are provided with image forming means of the electrophotographic type. This image forming means charges a photosensitive drum which is an image bearing member to thereby form an electrostatic latent image, which is electrostatically developed by a developing device provided with a developer.

This developing device is of such a construction that a developer such as a two-component toner comprising, for example, a mixture of a magnetic toner and a carrier consisting of a magnetic material is contained in a container and a developing sleeve having a magnet roll disposed therein is rotated while being in contact with the photosensitive drum. The developer adhering to the surface of the developing sleeve is transferred to an electrostatic latent image formed on the photosensitive drum, whereby development is effected.

Also, this developing method can be applied to an image forming apparatus utilizing a process cartridge removably mountable with respect to the image forming apparatus and provided with an image bearing member, a developing device, etc.

In such a developing device and such a process cartridge, a magnetic seal is devised to prevent the leakage of the toner from the end portion of the developing sleeve.

FIG. 7 of the accompanying drawings is a view showing the cross-sectional construction of a developing device 100 using a magnetic seal which is the background of the present invention. In FIG. 7, reference numeral 101 designates the developing container of the developing device, and a cross-section of the end portion thereof is shown in the figure. A sleeve 103 is rotatably mounted on the developing container 101 through a bearing 102.

Magnetic members 104 are disposed on the opposite ends of the developing sleeve 103 so as to surround the developing sleeve 103 with a predetermined gap from the outer peripheral surface thereof, and by a magnetic field formed between a magnet roll 105 in the developing sleeve 103 and the magnetic members 104, a magnetic curtain of toner 106 is formed between the developing sleeve 103 and the magnetic members 104 to thereby prevent the leakage of the toner 106 from the end portions of the developing sleeve 103.

FIG. 8 of the accompanying drawings shows the cross-sections of the developing sleeve 103, the magnetic member 104 and the magnet roll 105 on the cross-section 8—8 of FIG. 7, and represents the characteristic of the developing device 100. The magnet roll 105 is disposed in the developing sleeve 103. The magnet roll 105, as shown, is magnetized with four poles S1, S2, N1 and N2. By a magnetic field formed between this magnet roll 105 and the magnetic members 104, the toner 106 between the developing sleeve 103 and the magnetic members 104 is held to thereby prevent the leakage of the toner.

Since the magnetic force of the magnet roll 105 is set so as to be optimum for the developing operation, the maximum magnetic flux density of the formed magnetic field is of the order of 600–1000 gauss on the surface of the developing sleeve 103, and this has led to the possibility that when an impact is applied to the developing device, the toner holding force becomes deficient and the leakage of the toner occurs.

When as in a copying apparatus of the installation type, the developing device is fixed in the apparatus body and it is not necessary for a user to move the developing device, it is necessary to secure only the sealing property during the image forming operation of the apparatus, and the necessary sealing property has been provided by the magnetic seal as previously described.

However, in the case of the developing device or the process cartridge of a personal copying apparatus or printer, it is conceivable that an impact is applied when a user mounts or dismounts it with respect to the apparatus body or that an impact is applied by mistake when the apparatus is being carried and therefore, the construction utilizing the magnetic force of the magnet roll as previously described has not been free from the uneasiness in the toner sealing property.

So, as means for solving this problem, there is a construction in which a magnet is disposed so as to surround a developing sleeve with a predetermined gap from the outer peripheral surface of the developing sleeve to thereby provide a magnetic seal.

FIG. 9 of the accompanying drawings illustrates this construction. In FIG. 9, reference numeral 103 designates a developing sleeve, and reference numeral 107 denotes a magnet constituting a magnetic seal. The magnet 107 is disposed so as to surround the developing sleeve 103 with a predetermined gap g' from the outer peripheral surface of the developing sleeve 103. On that surface of the magnet 107 which is opposed to the developing sleeve 103, a plurality of magnetic poles (1)–(6) are disposed along the circumferential direction of the developing sleeve 103.

According to this construction, it is possible to set the magnetic force of the magnet 107 to a high level to thereby make the toner holding force of the gap g' great and therefore, it is easy to secure a sealing property against an impact.

The number of the magnetic poles of the magnet 107 may be suitably chosen depending on the diameter of the developing sleeve, the magnetic force of the magnet, etc. (in FIG. 9, the case of six poles is shown).

Magnetic lines of force produced by this magnet 107 are schematically shown in FIG. 10A of the accompanying drawings. As shown in FIG. 10A, the magnetic line of force in the end portion in the circumferential direction, unlike the magnetic line of force in the central portion in the circumferential direction, goes around the back 107*a* of the magnet 107. Therefore, the number of the magnetic lines of force travelling toward the sleeve 103 decreases, that is, the magnetic flux density Bγ in a vertical direction becomes small. Also, the magnetic flux density BE in a horizontal direction becomes small in the end portion in the circumferential direction of the magnet 107 as a matter of course because the back portion originally has no magnetized magnetic pole.

A magnetic field resulting from combining a magnetic field in the direction of normal and a magnetic field in the tangential direction between the magnetic poles of the magnet seal member 107 is made great, and the magnetic toner T is restrained by the action of this magnetic field, whereby the sealing property between the magnetic poles can be made good.

The magnetic flux density B on the developer carrier can be found from an equation $B=\sqrt{(B\gamma^2+B\theta^2)}$, where Bγ is the magnetic flux density 〖gauss〗 in the direction of the normal on the developer carrier, and Bθ is the magnetic flux density 〖gauss〗 in the tangential direction on the developer carrier.

FIG. 10B is a view for illustrating the positions of magnetic poles and the distribution form of the magnetic flux density on the surface position of the developer carrier of the magnet 107, and in FIG. 10B, the lateral direction indicates the position in the circumferential direction of the sleeve 103 as the developer carrier (in terms of angle) and the vertical direction indicates the magnitudes of the magnetic flux densities B, Bγ and Bθ on the sleeve. As shown in FIG. 10B, the magnet 107 is such that the magnetic flux density B in the end portion thereof is smaller than the magnetic flux density B in the central portion thereof. Accordingly, the leakage of the toner from this portion becomes liable to occur.

SUMMARY OF THE INVENTION

It is an object of the present invention to provide a developing device in which a reduction in the sealing property in the end portion of the magnetic seal is prevented.

It is another object of the present invention to provide a developing device in which a reduction in the magnetic restraining force in the end portion of the magnetic seal is prevented.

It is still another object of the present invention to provide a developing device including:

a container for containing a magnetic developer therein;

a developer carrier for carrying and conveying the magnetic developer in said container;

a magnetic member for forming a magnetic seal area of a predetermined gap with respect to the surface of said developer carrier in the end portions of said developer carrier along the circumferential direction of said developer carrier, said magnetic member having a plurality of magnetic poles along the circumferential direction of said developer carrier in said magnetic seal area; and an external magnetic pole provided outside said magnetic seal area for converging a magnetic flux travelling from the endmost magnetic pole in the magnetic seal toward the outside of the magnetic seal area.

Further objects of the present invention will become apparent from the following description.

DESCRIPTION OF THE PREFERRED EMBODIMENTS

Some embodiments of the present invention will hereinafter be described with reference to the drawings.

(Embodiment 1)

Figure 1:
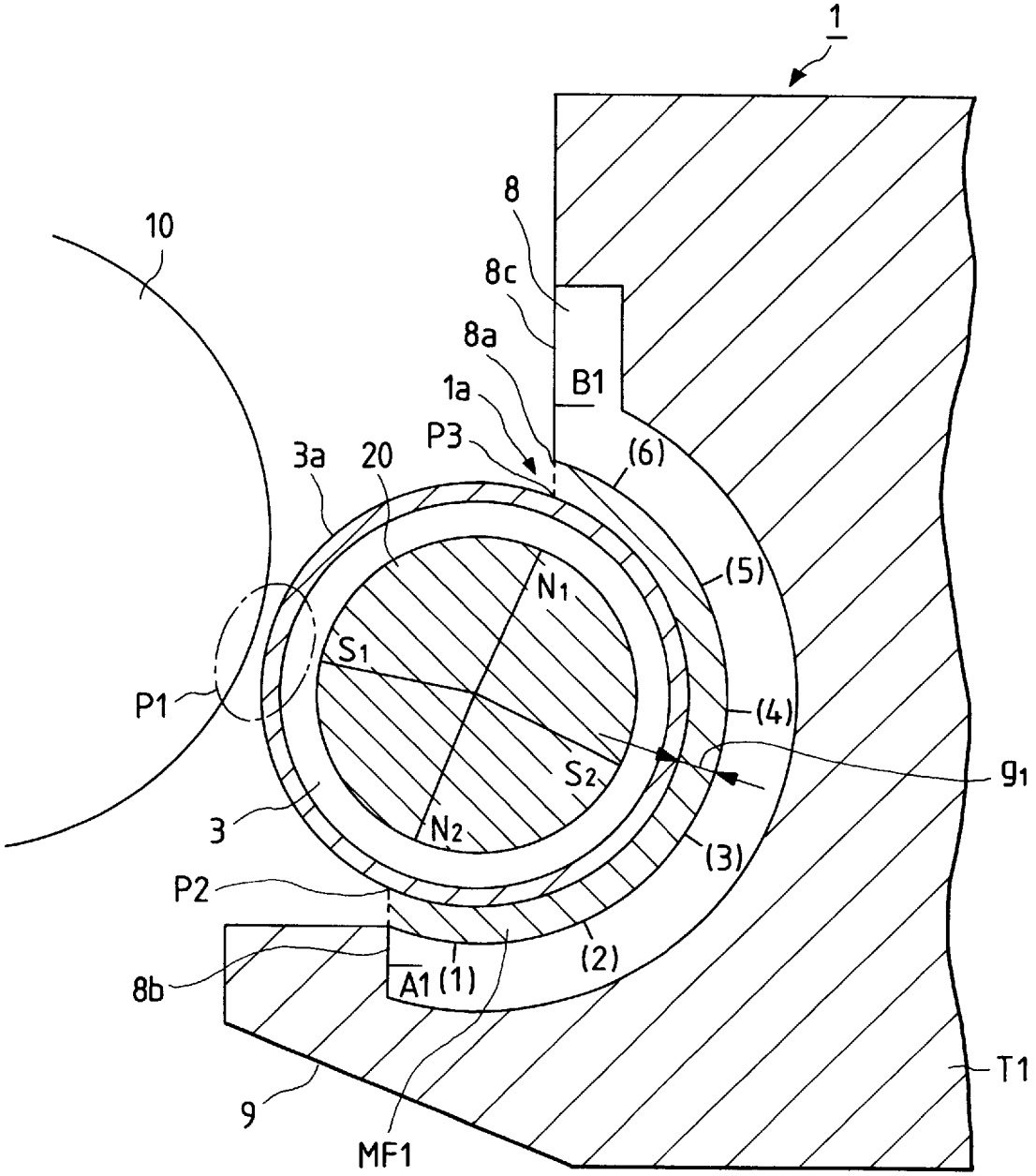
FIG. 1 is a cross-sectional view of a developing device according to an embodiment of the present invention.

FIG. 1 is a partly cross-sectional view of a developing device according to an embodiment of the present invention.

The developing device according to the present embodiment is constructed as a process cartridge 1 removably mountable on an image forming apparatus body integrally with an image bearing member bearing an electrostatic latent image thereon.

The process cartridge may further have a cleaner or the like for removing any residual toner after transfer.

In FIG. 1, reference numeral 10 designates an image bearing member on the outer peripheral surface of which is formed an electrostatic latent image. Reference numeral 3 denotes a developing sleeve as developer conveying means for developing the electrostatic latent image formed on the image bearing member 10. The opposite ends of the developing sleeve 3 are rotatably supported on a developing container 9 as a container by bearings (not shown). Thus, the outer peripheral surface of the developing sleeve 3 provides a conveying surface 3*a* for conveying a developer, and by this conveying surface 3*a* being rotatively moved, the developer is conveyed to a developing area P1 proximate to the image bearing member 10.

A magnetic toner T1 as a developer to be magnetically absorbed is contained in the developing container 9, and adheres to the developing sleeve 3 by the magnetic force of a magnet roller 20 disposed in the developing sleeve 3, and is conveyed to the image bearing member 10 by the developing sleeve 3 being rotated.

A magnet 8 as magnetic force producing means is provided with an opposed surface 8*a* opposed to the conveying surface 3*a* of the developing sleeve 3 so as to surround the developing sleeve 3 with a predetermined gap g1. By a magnetic field produced by this magnet 8, a magnetic seal portion MF1 is formed in the gap g1 to thereby prevent the leakage of the magnetic toner T1 from the opposite end portions of the developing sleeve 3.

The magnet 8 is such that in the magnetic seal area of the opposed surface 8*a* thereof opposed to the developing sleeve 3, six magnetic poles (1)–(6) are magnetized along the circumferential direction of the developing sleeve. The magnetic forces of these magnetic poles may desirably be high for the purpose of holding the magnetic toner T1 intervening in the gap g1 and preventing the leakage thereof. In FIG. 1, the locations of the magnetic poles are represented as solid lines.

Also, the magnet 8 has at the opposite ends of the opposed surface 8*a* end surface portions 8*b* and 8*c* spaced apart from the conveying surface 3*a* of the developing sleeve 3, and end portion magnetic poles A1 and B1 are formed on these end surface portions 8*b* and 8*c*, respectively. These end portion magnetic poles A1 and B1 caused magnetic fluxes emanated from the magnetic poles (1)–(6) on the opposed surface 8*a*, to be converged and more particularly, the end portion magnetic pole A1 forms a magnetic flux connected to the magnetic pole (1), and the end portion magnetic pole B1 forms a magnetic flux connected to the magnetic pole (6).

The end portion magnetic poles A1 and B1 are provided at locations which are outside the endmost magnetic poles (1) and (6) in the magnetic seal area and of which the distance from the surface of the developing sleeve 3 is greater than that of the endmost magnetic poles (1) and (6).

Figure 2A:
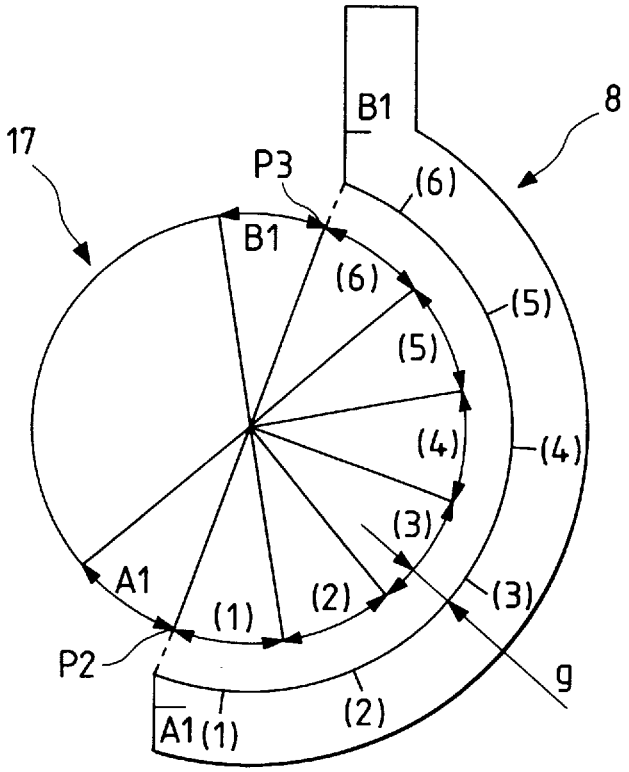
FIG. 2A show a magnetic flux density measuring position.
Figure 2B:
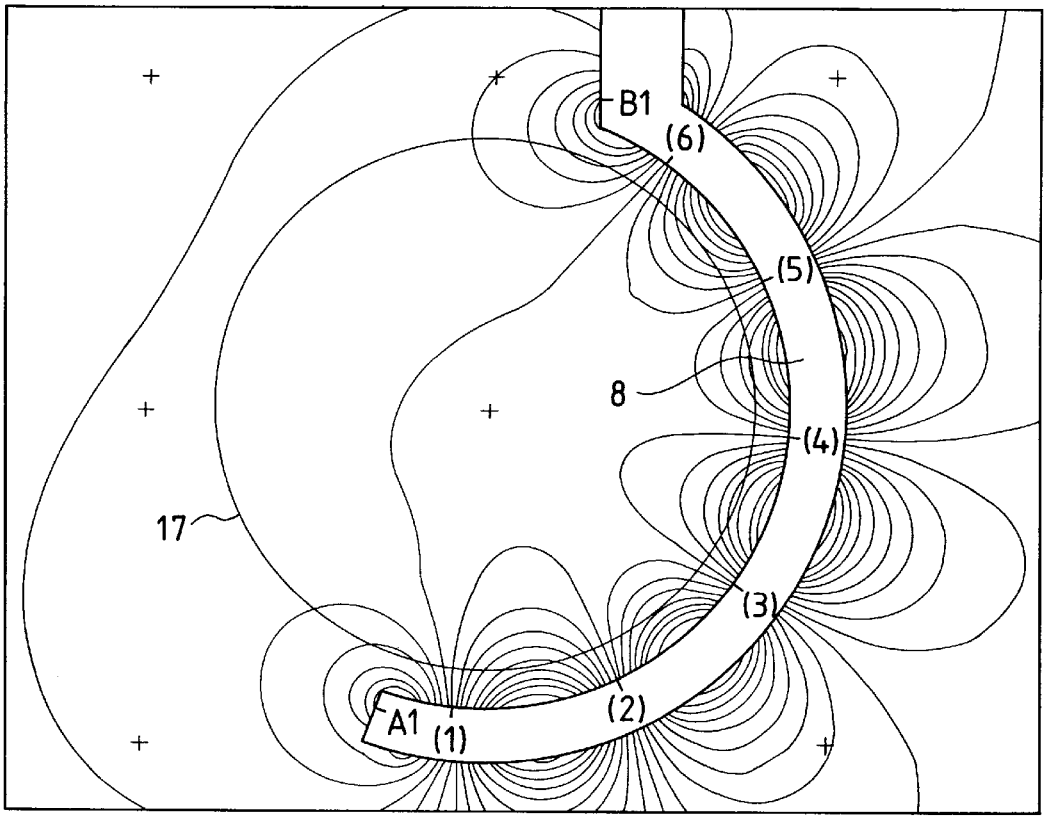
FIG. 2B shows magnetic lines of force.
Figure 2C:
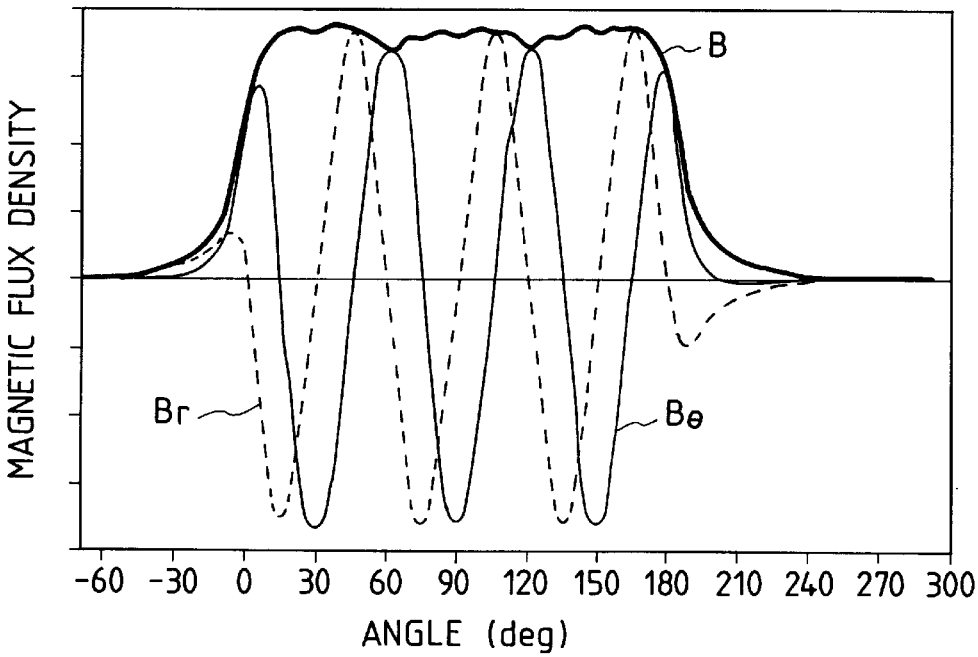
FIG. 2C is a magnetic flux density distribution graph.

FIGS. 2A to 2C show the magnetic flux densities at locations on the conveying surface 3*a* of the developing sleeve 3 which correspond to the magnetic poles (1)–(6) of the magnet 8.

FIG. 2A is a view for illustrating a magnetic flux density measuring position. Reference numeral 17 designates an imaginary circle having the same diameter as that of the developing sleeve 3. A Hall element for measuring the magnetic flux density is disposed on this circle 17, and the inner peripheral surface (magnetized surface) of the magnet 8 disposed on a circle concentric with the imaginary circle 17 is rotated on the circle concentric with the imaginary circle 17, whereby the magnetic flux density is measured.

That is, the measuring positions for the magnetic flux densities of the magnetic poles (1)–(6) and the magnetic poles A1 and B1 correspond to the ranges of arrows (1)–(6) and A1 and B1 in FIG. 2A.

FIG. 2B shows magnetic lines of force produced by the magnet 8.

Figure 9:
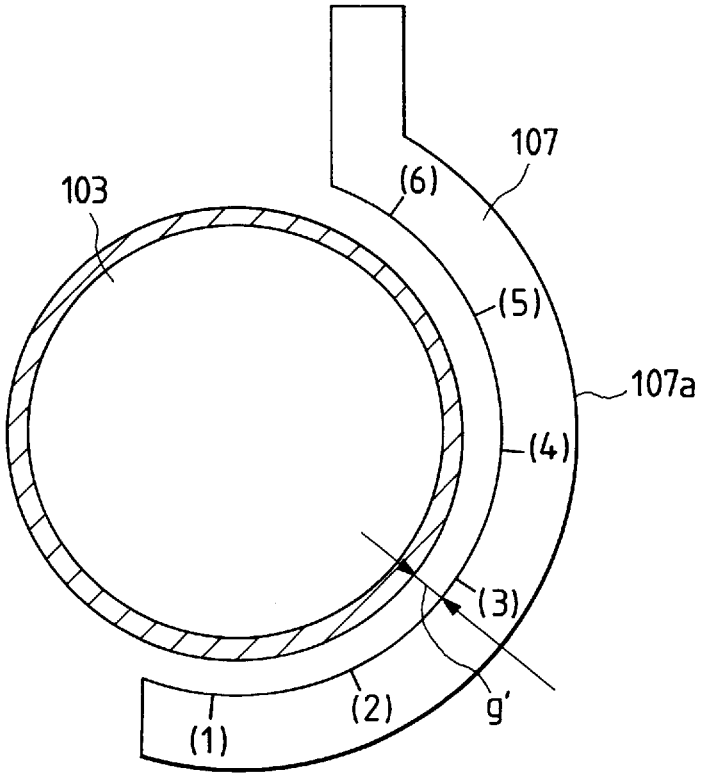
FIG. 9 shows the magnetized positions of the magnet of the developing device of FIG. 7.
Figure 10A:
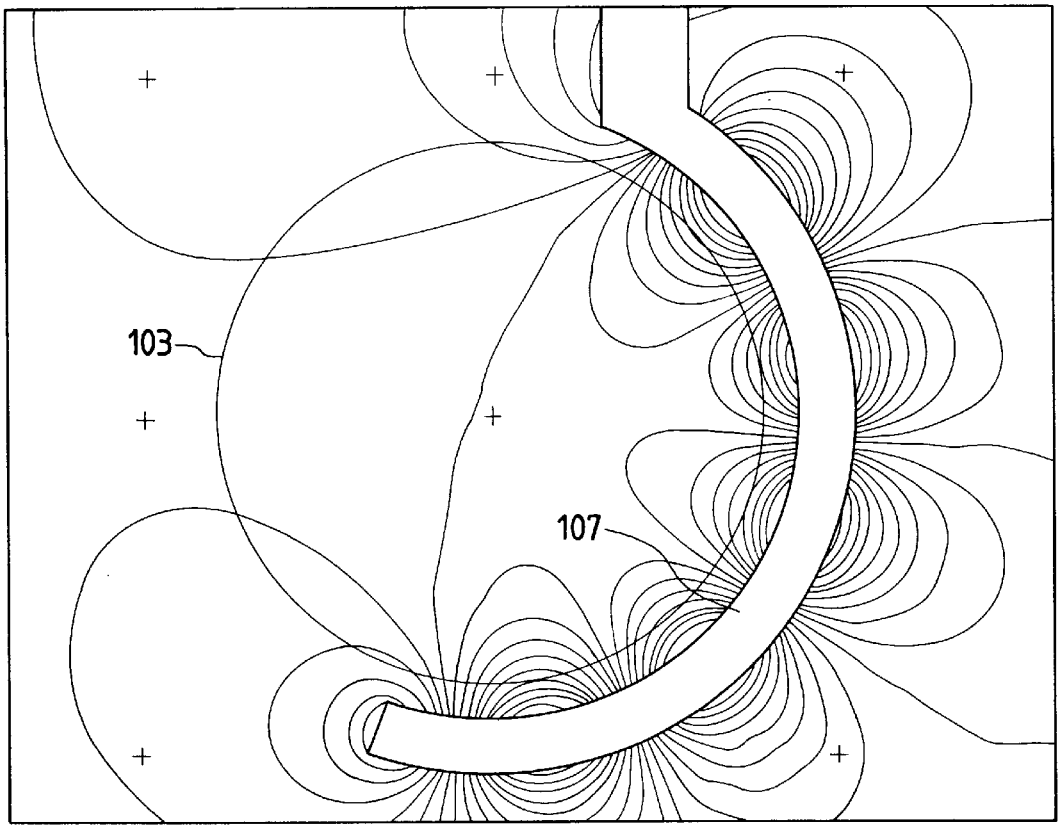
FIG. 10A shows magnetic lines of force.

When compared with a magnetic line of force (FIG. 10A) near the end portion in the circumferential direction by the magnetization pattern shown in FIG. 9, the magnetic lines of force emanated from the magnetic poles (1) and (6) on the magnet 8 converge into the end portion magnetic poles A1 and B1. Therefore, in the example shown in FIG. 9, the magnetic line of force which has travelled around the back of the magnet converges to the end portion of the magnet and thus, the magnetic flux density $B\gamma$ in a vertical direction becomes great. Also, the magnetic flux density $B\theta$ in a horizontal direction is formed between the magnetic pole (1) and A1 and between the magnetic pole (6) and B1 and therefore, the magnetic lines of force emanated from the magnetic poles (1) and (6) becomes greater than the magnetic line of force (FIG. 10A) which travels around the back of the magnet.

As previously described, the magnetic flux density B which is the resultant force of $B\gamma$ and $B\theta$ can be found from $B=\sqrt{B\gamma^2+B\theta^2}$.

The magnetic restraining force is proportional to this B.

FIG. 2C shows the magnetic flux density B on the sleeve formed by the magnet 8, the magnetic flux density By in the vertical direction and the magnetic flux density $B\theta$ in the horizontal direction.

Figure 10B:
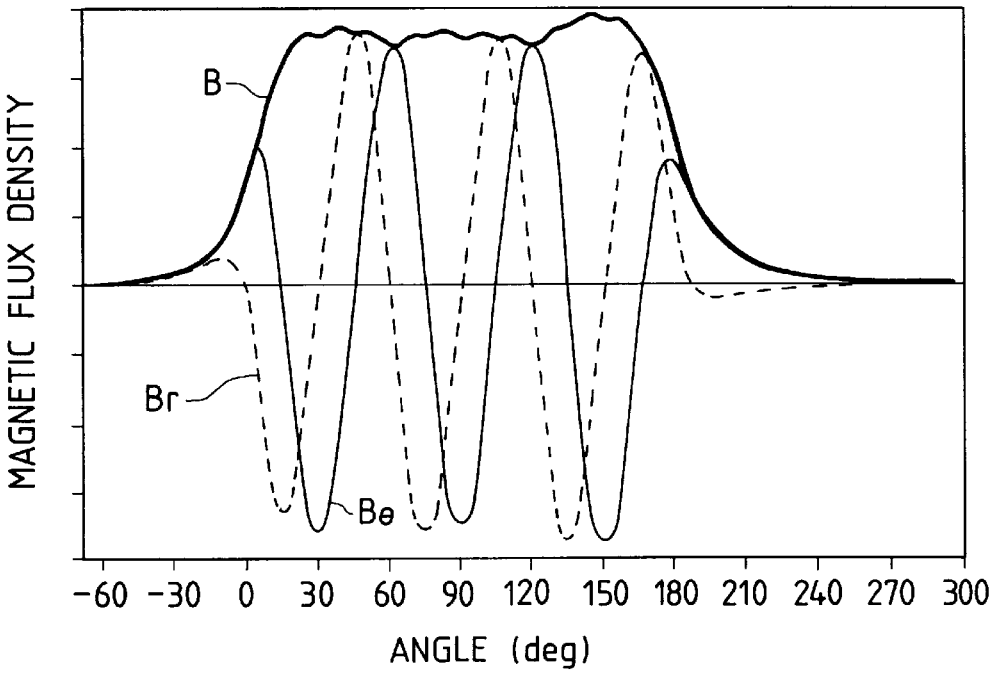
FIG. 10B is a magnetic flux density distribution graph.

When FIG. 10B showing the magnetic flux density B in the example of FIG. 9 and FIG. 2C showing the magnetic flux density B in the present embodiment are compared with each other, the magnetic flux density in the end portion in the circumferential direction is greater in the present embodiment.

Also, the force restraining the magnetic toner depends on the magnetic flux density B and therefore, the magnetic restraining force for the magnetic toner in the end portion in the circumferential direction becomes great and the sealing property for the toner is improved.

Further, the magnetic flux densities at positions substantially opposed to the magnetic poles A1 and B1 on the end surface portions 8*b* and 8*c* outside the magnetic poles (1) and (6) shown in FIG. 1 by the magnet roller 20 included in the developing sleeve 3 are greater than the magnetic flux densities of the magnetic poles A1 and B1. Thus, the developer accumulating on the magnetic poles A1 and B1 is attracted by the magnetic force of the magnet roller 20 having a greater magnetic force than the magnetic poles A1 and B1, and this attracted developer is attracted into the gap between the magnet 8 and the developing sleeve 3 through the surface of the developing sleeve 3. That is, the developer is attracted into the range of the magnetic poles (1)–(6) of the magnet 8, and is held by the magnetic poles (1)–(6) at last.

In the present embodiment, an aluminum material having an outer diameter of 16 mm can be used as the developing sleeve 3, and a bond magnet formed of neodymium, iron and boron as raw materials is used as the magnet 8 as magnetic force producing means. The magnetic poles thereof total to eight, i.e., six poles on the opposed surface 8a to the developing sleeve 3, and one pole outside each of the opposite end portions in the circumferential direction, as previously described. This magnet 8 is disposed with a gap (gap g1) of 0.2–0.6 mm with respect to the developing sleeve 3.

The magnetic flux density of the magnet 8 is about 1900 gauss at a location corresponding to the surface of the developing sleeve 3 (a location of 0.4 mm from the opposed surface 8*a* of the magnet 8). The magnetic flux density of the end portion of the magnet 8 is 5–30% of that at the location corresponding to the surface of the developing sleeve 3.

Also, the magnetic flux density of the magnet roller 20 opposed to the end portion of the magnet 8 is 700 gauss.

The locations of the end portion magnetic poles A1 and B1 are outside the magnetic seal area. Therefore, it is preferable that the toner do not adhere to these magnetic poles A1 and B1.

So, the magnetic flux density at the surface position of the developing sleeve 3 is made smaller than that in the seal area, whereby the amount of held developer becomes small near the end portion magnetic poles, and the amount of developer stagnating in the end surface portion decreases and thus, the amount of developer dropping or peeling from this portion is reduced.

If the magnetic force of the end portion magnetic poles is made too small for this purpose, the converging effect of the magnetic flux travelling toward the outside of the seal area will become small and therefore, it is preferable that the distance between the end portion magnetic poles and the surface of the developing sleeve is made greater than the distance between the magnetic pole of the seal area and the surface of the developing sleeve.

Thereby, the holding of the developer can be prevented by the end portion magnetic poles while the high convergence of the magnetic flux is obtained.

When a toner leakage test was carried out with an impact of about 50 G imparted to the process cartridge 1 using these constructions and the magnetic toner of a particle diameter of 5–7 $\mu$m, the toner leakage from the gap portion, particularly the end portion of the magnetic seal area near P2 and P3 did not occur.

The present invention is not restricted to the above-described embodiment, but can obtain a similar effect by using a magnet having an appropriate magnetic force in conformity with the magnitude of the gap and the kind of the developer used.

For example, there is a case where the outer diameter of the developing sleeve is enlarged to prevent the thinning of the image density due to the deficiency of the toner supply when the speeding-up of the printing by a printer using the present process cartridge is effected. In the present study, an experiment was carried out with a developing sleeve formed of an aluminum material having an outer diameter of 20 mm used. The magnetic seal was disposed with gap of 0.2–0.6 mm from the developing sleeve, and a magnet having eight magnetic poles magnetized was used on the opposed surface of the magnetic seal to the developing sleeve. Here, a pole of which the magnetic flux density is 5–30% of that at a location corresponding to the surface of the developing sleeve is respectively disposed outside the opposite end portions of the magnetic seal in the circumferential direction thereof, and ten magnetic poles in total are given. As a result of the experiment, the toner leakage from the end portions of the magnetic seal did not occur as in the magnetic seal for a developing sleeve having an outer diameter of 16 mm.

(Embodiment 2)

Figure 3:
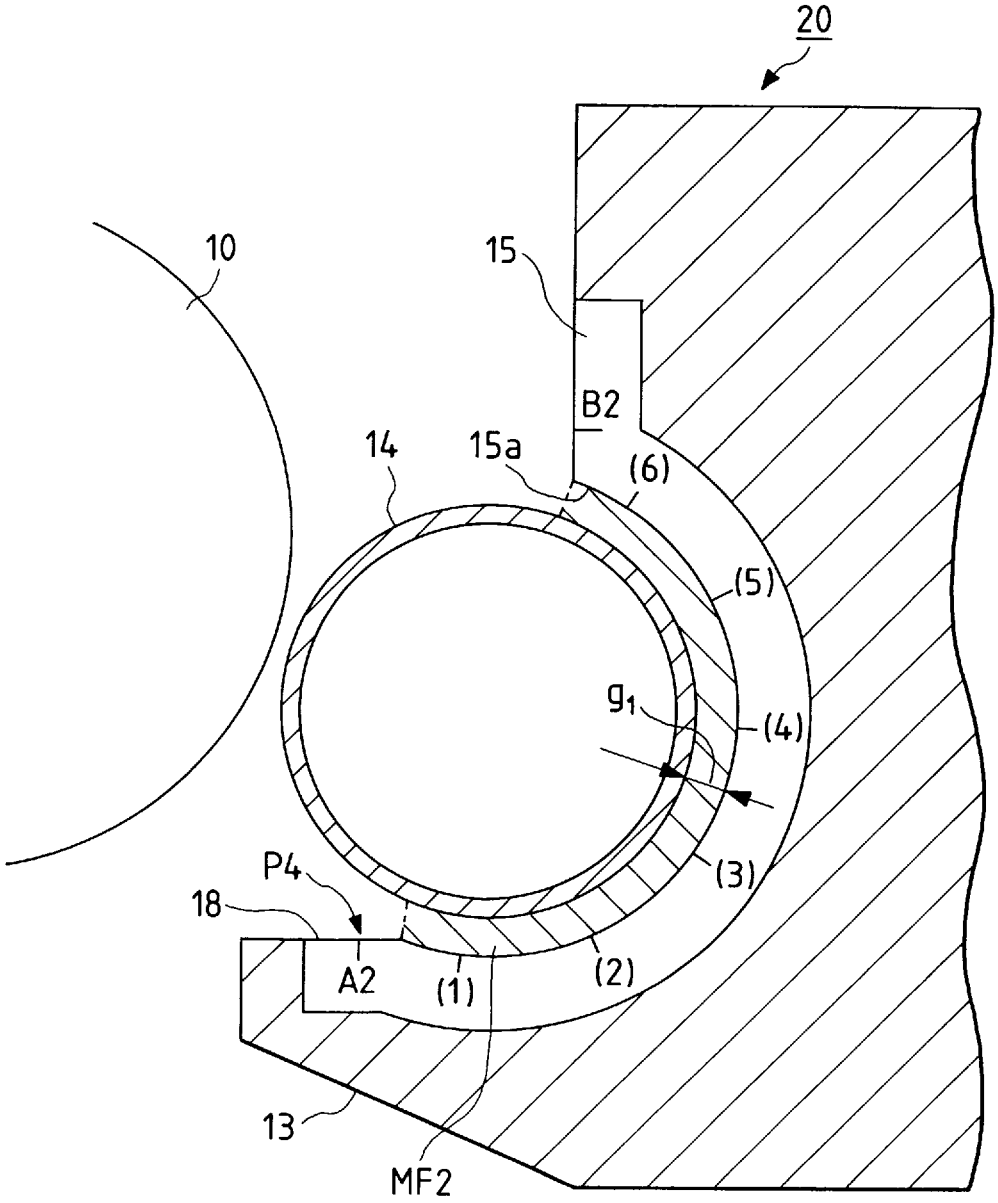
FIGS. 3 and 4 are partly cross-sectional views of developing devices according to other embodiments of the present invention.

A second embodiment of the present invention will now be described with reference to FIG. 3. In FIG. 3, reference numeral 13 designates the developing container of a process cartridge 20. Reference numeral 14 denotes a developing sleeve rotatably supported on the developing container 13 by a bearing, not shown. The construction in which a magnet 15 is disposed with a predetermined gap with respect to the developing sleeve 14 to thereby prevent the leakage of the toner from the opposite end portions of the developing sleeve 14 is similar to that of the first embodiment.

However, unlike the first embodiment, the shape of the end portion of the magnet 15 has a planar portion 18 spaced apart from a magnetic seal portion MF2 formed in the gap g1. Even when the magnet 15 assumes such a shape in terms of the construction of parts, a magnetic pole is also formed outside the opposed surface 15*a* to the developing sleeve 14 as described in connection with the first embodiment, whereby the magnetic force in the end portions of the opposed surface 15*a* can be prevented from becoming low and the leakage of the toner can be prevented.

However, when the period of use of the process cartridge and the developing device is long, the magnetic toner T1 adhering to the developing sleeve 14 is attracted downstream of the developing area by a magnetic pole A2 outside the opposed surface due to the repetition of the developing operation and the magnetic toner T1 collects near the lower proportion P4 of the developing sleeve, and there is the possibility of the leakage of the toner occurring.

In the present embodiment, the magnetic force of the end portion magnetic poles A2 and B2 on the surface of the developing sleeve 14 is made smaller than the magnetic force of the magnetic poles (1)–(6) of the opposed surface on the surface of the developing sleeve 14. Therefore, even if the developing operation is repeated for a long time, the magnetic toner T1 will not collect near the portion P4 and a stable seating property will be obtained. The magnetic force of the end portion magnetic poles A2 and B2 may preferably be smaller than the magnetic force of the magnetic poles (1)–(6) on the opposed surface 15*a*, and specifically it is desirable that it be 5–30% of the magnetic force of the magnetic poles (1)–(6) on the opposed surface 15*a*.

The other constituents are given the same reference numerals as those in the first embodiment and need not be described in detail.

(Embodiment 3)

Figure 4:
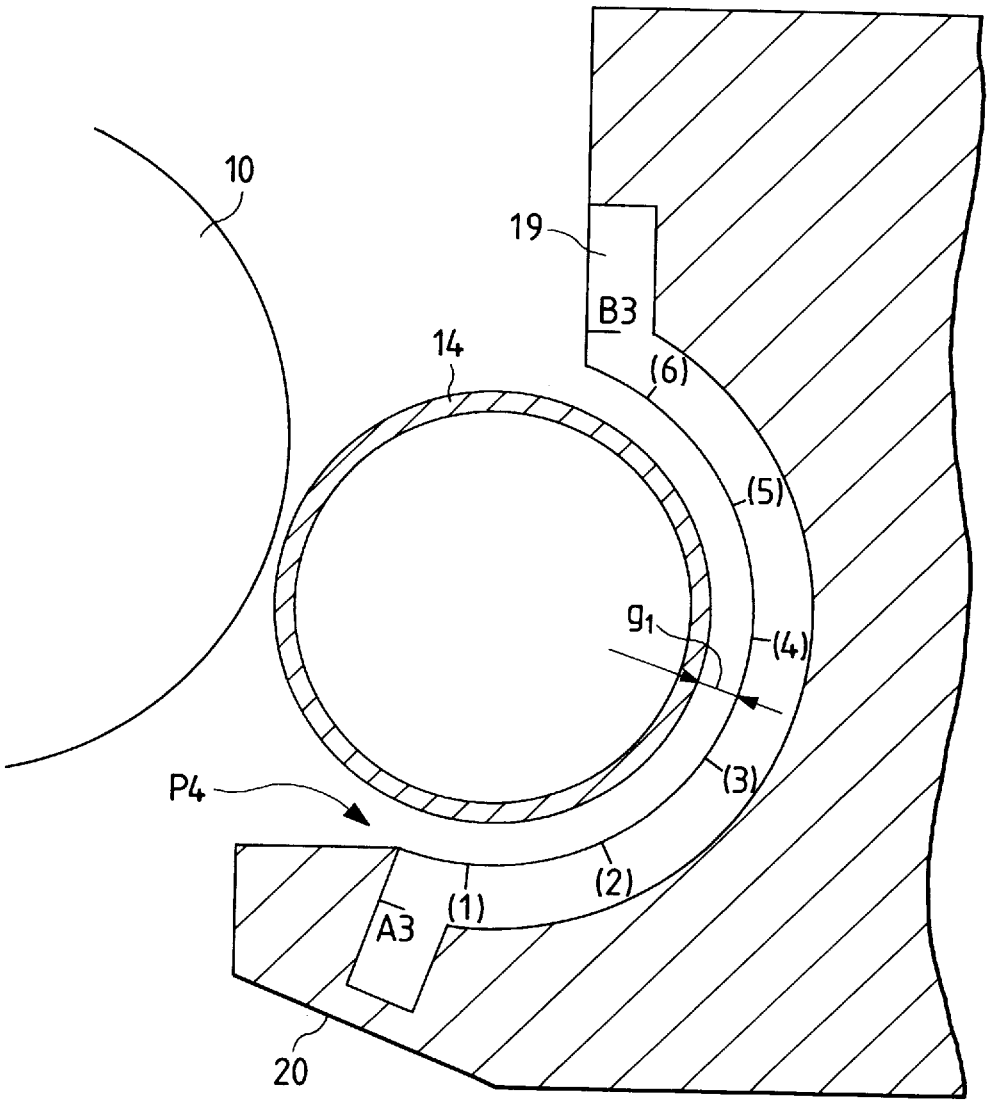

FIG. 4 shows a third embodiment of the present invention. The basic construction of this embodiment is similar to that of the aforedescribed second embodiment.

It has already been described that it is better to make the magnetic force of the end portion magnetic pole A3 on the surface of the developing sleeve 14 small, but in the present embodiment, the shape of the end portion 20 of a magnet 19 is made into such a shape that it escapes from the surface of the developing sleeve as shown, whereby the magnetic flux density of the end portion magnetic pole A3 on the surface of the developing sleeve 14 becomes small.

By doing so, as in the second embodiment, the magnetic toner T1 can be prevented from collecting near the lower portion P4 of the developing sleeve 14.

(Embodiment 4)

Figure 5:
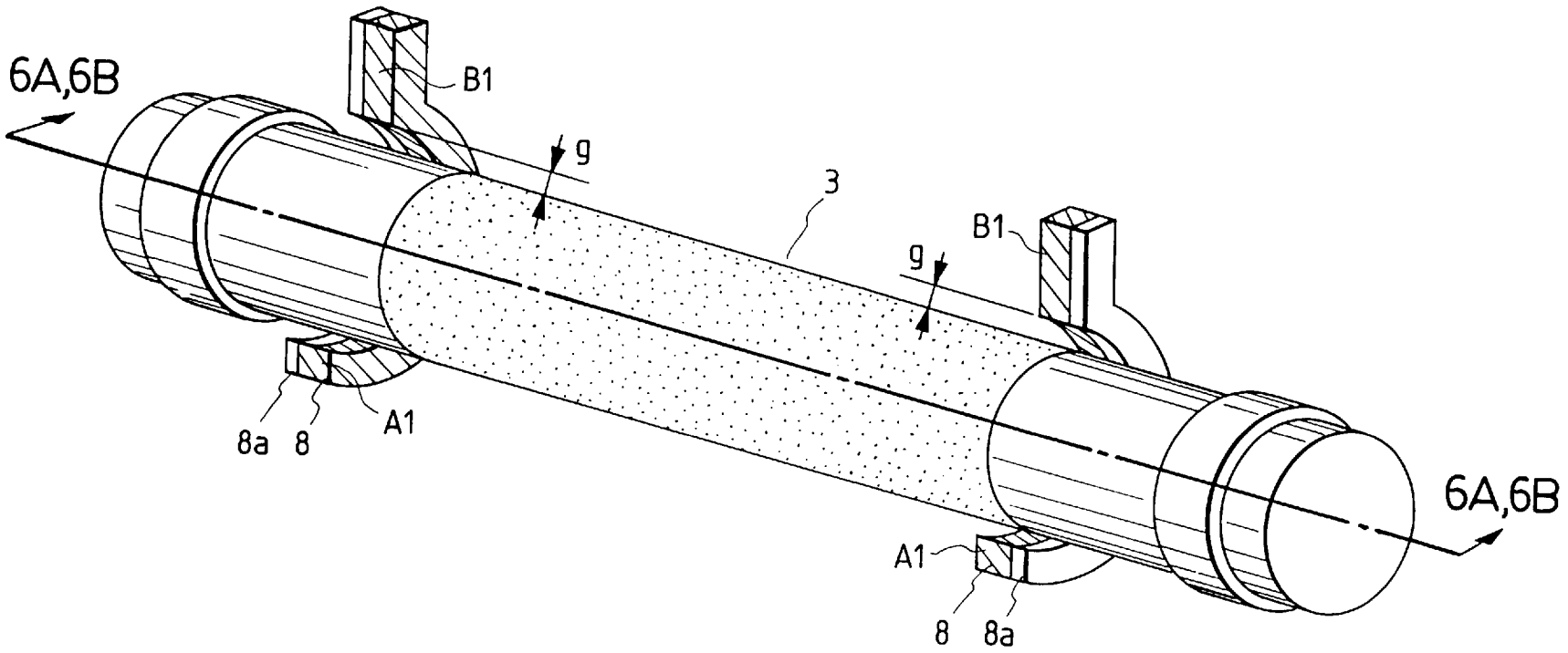
FIG. 5 is a fragmentary perspective view of a developing device according to another embodiment of the present invention.
Figures 6A, 6B:
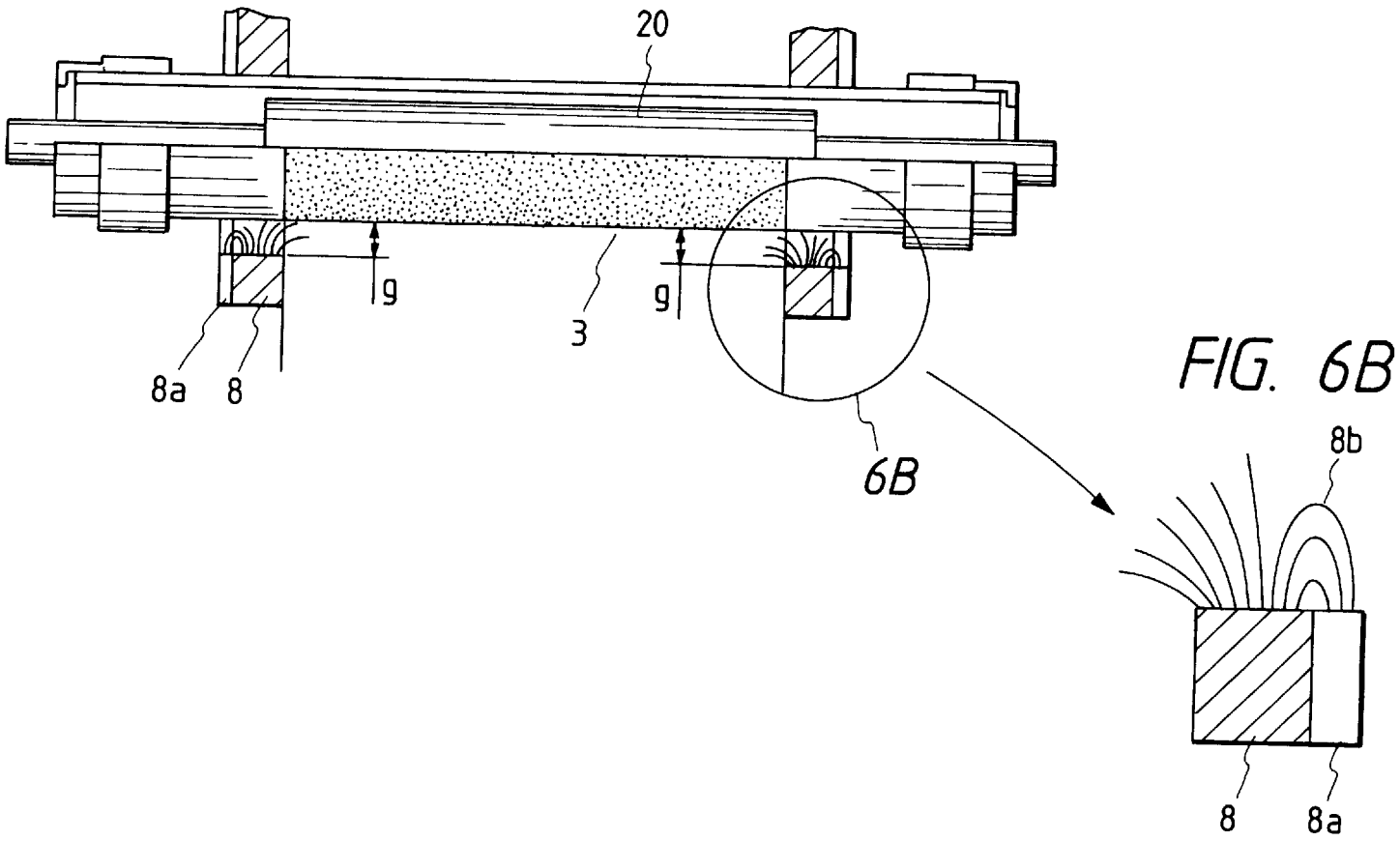
FIG. 6A is a front view of the FIG. 5 device.
FIG. 6B shows a magnetic line of force.
Figure 7:
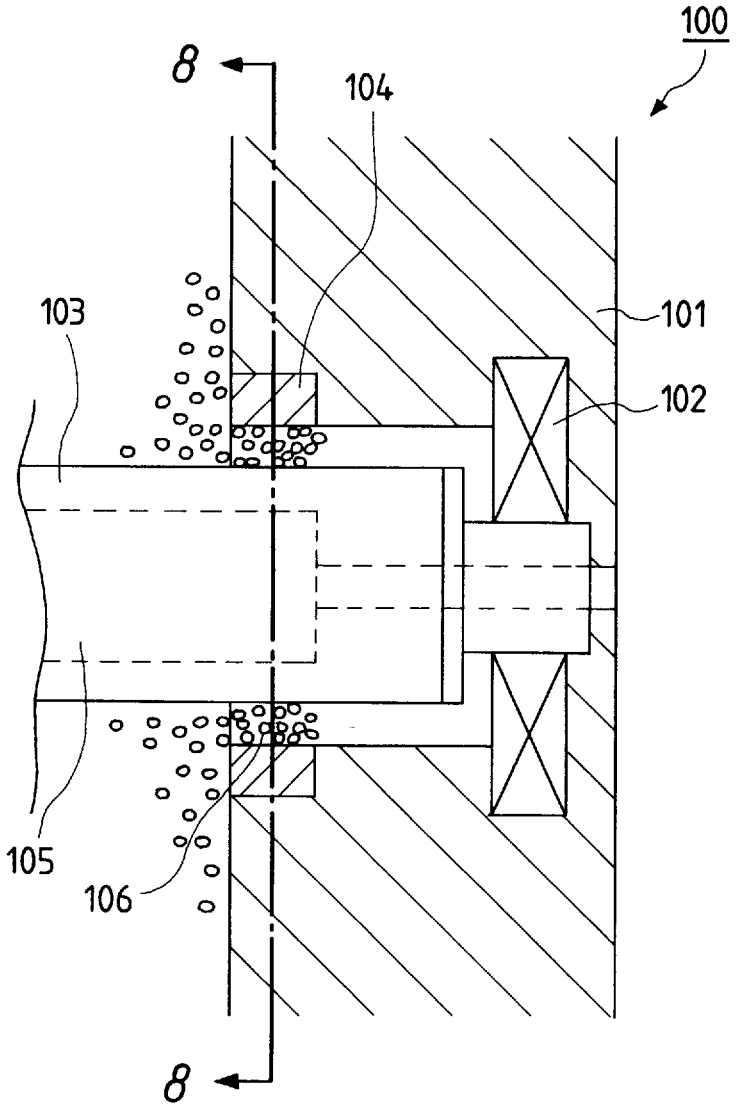
FIG. 7 is a partly cross-sectional view of a developing device which is the background of the present invention.
Figure 8:
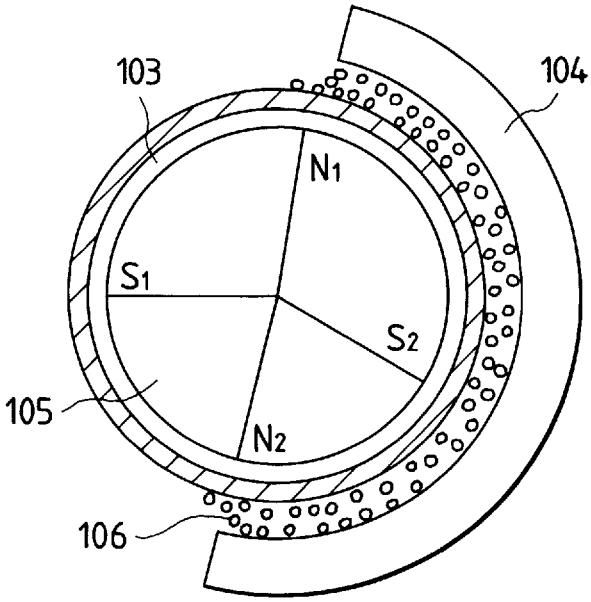
FIG. 8 is a side cross-sectional view of the developing device of FIG. 7.

FIG. 5 shows a fourth embodiment of the present invention. FIGS. 6A and 6B are cross-sectional views of the embodiment of FIG. 5. The basic construction of this embodiment is similar to that of the aforedescribed first embodiment.

As shown in FIG. 5, a magnetic member 8*a* is disposed on the axial outer side of the magnet 8. At this time, a magnetic line of force 8*b* spreading axially of the magnet 8 converges on the magnetic member 8*a*. The magnetic toner T1 is diffused along the magnetic line of force and therefore, by the magnetic member 8*a* being disposed on the axial outer side of the magnet 8, the diffusion of the magnetic toner T1 in the axial direction can be prevented.

While the embodiments of the present invention have been described above, the present invention is not restricted to these embodiments, but all modifications are possible within the technical idea of the present invention.

What is claimed is:

1. A developing device including:

a container for containing a magnetic developer therein;

a developer carrier for carrying and conveying the magnetic developer in said container;

a magnetic member for forming a magnetic seal area of a predetermined gap with respect to the surface of said developer carrier in the end portions of said developer carrier along the circumferential direction of said developer carrier, said magnetic member having a plurality of magnetic poles along the circumferential direction of said developer carrier in said magnetic seal area; and an external magnetic pole provided outside the endmost magnetic pole forming said magnetic seal for converging a magnetic flux travelling from the endmost magnetic pole toward the outside of said magnetic seal area.

2. A developing device according to claim 1, wherein the external magnetic pole is provided near the endmost magnetic pole.

3. A developing device according to claim 2, wherein the external magnetic pole is provided on said magnetic member.

4. A developing device according to claim 3, wherein the external magnetic pole is provided on the lengthwise end surface of said magnetic member.

5. A developing device according to claim 1, wherein the distance between the external magnetic pole and the surface of said developer carrier is greater than the distance between a magnetic pole in the seal and the surface of said developer carrier.

6. A developing device according to claim 1, wherein the external magnetic pole is opposite in polarity to the endmost magnetic pole.

7. A developing device according to claim 1, wherein the external magnetic pole is smaller in magnetic force than the magnetic pole in the seal.

8. A developing device according to claim 7, wherein the magnetic force of the external magnetic pole is 5 to 30% of the magnetic force of the magnetic pole in the seal.

9. A developing device according to claim 1, wherein said container has an opening portion, and said developer carrier is provided in the opening portion.

10. A developing device according to claim 9, wherein said developer carrier forms a developing area in opposed relationship with an electrostatic latent image bearing member.

* * * * *